US010728981B2

(12) United States Patent
Ho et al.

(10) Patent No.: US 10,728,981 B2
(45) Date of Patent: Jul. 28, 2020

(54) TRANSFORMERLESS SINGLE-PHASE UNIFIED POWER QUALITY CONDITIONER (UPQC) FOR LARGE SCALE LED LIGHTING NETWORKS

(71) Applicant: University of Manitoba, Winnipeg (CA)

(72) Inventors: Ngai Man Ho, Winnipeg (CA); Radwa Abdalaal, Winnipeg (CA); Henry Shu Hung Chung, Winnipeg, Manitoba (CA)

(73) Assignee: University of Manitoba, Winnipeg, Manitoba (CA)

( * ) Notice: Subject to any disclaimer, the term of this patent is extended or adjusted under 35 U.S.C. 154(b) by 0 days.

(21) Appl. No.: 16/185,668

(22) Filed: Nov. 9, 2018

(65) Prior Publication Data

US 2019/0182917 A1 Jun. 13, 2019

Related U.S. Application Data

(60) Provisional application No. 62/584,526, filed on Nov. 10, 2017.

(51) Int. Cl.
*H05B 45/37* (2020.01)
*H05B 45/44* (2020.01)
*H05B 45/00* (2020.01)

(52) U.S. Cl.
CPC ..... *H05B 45/37* (2020.01); *H05B 45/00* (2020.01); *H05B 45/44* (2020.01)

(58) Field of Classification Search
None
See application file for complete search history.

(56) References Cited

U.S. PATENT DOCUMENTS 6,249,108 B1 * 6/2001 Smedley ..... H02J 3/1842 323/207
7,411,359 B2 8/2008 Chung et al.
2013/0119882 A1 * 5/2013 Mao ..... H05B 33/0815 315/210

FOREIGN PATENT DOCUMENTS

CN 103560520 A * 2/2014
GB 2418786 B 11/2006

OTHER PUBLICATIONS

Electromagnetic Compatibility (EMC)—Part 3-2: Limits—Limits for Harmonic Current Emissions (equipment input current<16 A phase); IEC 61000-3-2:2000; Second Addition; Aug. 2000.

(Continued)

*Primary Examiner* — Dedei K Hammond
(74) *Attorney, Agent, or Firm* — Gowling WLG (Canada) LLP

(57) ABSTRACT

Low cost and low power LED lamps exhibit current harmonic contents due to their nonlinear characteristics. A large scale lighting network requires tens to hundreds LED lamp installations, the resultant harmonic currents pollute the grid seriously. Furthermore, light intensity fluctuations are becoming a concern nowadays to many users, as a safety and a health problems. This phenomenon is mainly caused by heavy loads as they lead to voltage fluctuations and deteriorating in PQ and hence visual flickering in LED lamps. A single phase transformer-less unified power quality conditioner (UPQC) topology is provided with its controls to mitigate all PQ problems in a network.

17 Claims, 11 Drawing Sheets

(56) References Cited

OTHER PUBLICATIONS

A. M. Blanco and E. E. Parra; "Effects of High Penetration of CFLs and LEDs on the Distribution Networks"; Harmonics and Quality of Power (ICHQP), 2010 14th International Conference; pp. 1-5.

Mathieu Morati et al.; "Industrial 100-MVA EAF Voltage Flicker Mitigation Using VSC-Based STATCOM With Improved Performance"; IEEE Transactions on Power Delivery, vol. 31, No. 6, Dec. 2016.

Manuel Arias et al.; "Design of a Soft-Switching Asymmetrical Half-Bridge Converter as Second Stage of an LED Driver for Street Lighting Application"; IEEE Transactions on Power Electronics, vol. 27, No. 3, Mar. 2012.

David A. Torrey et al.; "Single-phase Active Power Filters for Multiple Nonlinear Loads"; IEEE Transactions on Power Electronics; vol. 10, No. 3, May 1995.

Zhenyu Shan et al.; "Using LED Lighting Drivers for Harmonic Current Cancellation in Intelligent Distribution Power Systems"; IEEE 17th Workshop on Control and Modeling for Power Electronics (COMPEL), 2016.

Keyue M. Smedley et al.; "Unified Constant-Frequency Integration Control of Active Power Filters—Steady-State and Dynamics"; IEEE Transactions on Power Electronics, vol. 16, No. 3, May 2001; pp. 428-436.

M.El-Habrouk et al.; "Active power filters: A review"; IEE Proc.-Elertr. Power Appl., vol. 147, No. 5, Sep. 2000; pp. 403-413.

Taekhyun Kim et al.; "LED Lamp Flicker Caused by Interharmonics"; I2MTC 2008—IEEE International Instrumentation and Measurement Technology Conference; Victoria, Vancouver Island, Canada, May 12-15, 2008.

Guilherme Gindri Pereira et al.; "LED Driver Based on Input Current Shaper Without Electrolytic Capacitor"; IEEE Transactions on Industrial Electronics, vol. 64, No. 6, Jun. 2017; pp. 4520-4527.

Brad Lehman and Arnold J. Wilkins; Designing to Mitigate the Effects of Flicker in LED Lighting; IEEE Power Electronics Magazine, Sep. 2014, pp. 18-26.

Carl Ngai-man Ho et al.; "Design and Implementation of a Fast Dynamic Control Scheme for Capacitor-Supported Dynamic Voltage Restorers"; IEEE Transactions on Power Electronics, vol. 23, No. 1, Jan. 2008; pp. 237-251.

Carl N.M. Ho and Henry S.H. Chung; "Fast Dynamic Control Scheme for Capacitor-Supported Dynamic Voltage Restorers: Design Issues, Implementation and Analysis"; IEEE Power Electronics Specialists Conference; Jun. 2007.

* cited by examiner

TRANSFORMERLESS SINGLE-PHASE UNIFIED POWER QUALITY CONDITIONER (UPQC) FOR LARGE SCALE LED LIGHTING NETWORKS

CROSS-REFERENCE TO RELATED APPLICATIONS

This application is a non-provisional application of U.S. Provisional Application No. 62/584,526 filed Nov. 10, 2017 which is herewith incorporated by reference in it's entirety for all purposes.

TECHNICAL FIELD

The present disclosure relates to large scale light emitting diodes (LED) lighting networks and in particular to power quality issues associated with the LED lighting networks.

BACKGROUND

It is well-known that the main advantages of using light emitting diode (LED) lamps are long lifetime and low energy consumption when compared to conventional lighting technologies, such as incandescent lamps and florescent lamps. Therefore, many governments are encouraging residential users and electricity providers to replace conventional lighting sources with LED lamps to endorse energy savings. Since most of LED lamps are for residential applications, rated power per lamp is usually from 5 to 30 W, Power Factor Correction (PFC) requirement is not applied to those products, such as EN61000-3-2. Thus, some low cost LED lamps generate harmonic currents to the grid that affects the power system network when lamps are used in a large scale lighting system such as a street lighting network and a parking building lighting network. Researchers have analyzed the harmonics emission of large penetration of LED lamps, in which it was found that the nonlinear characteristics of the LEDs result in a low Power Factor (PF), around 0.5, with total harmonic distortion (THD) between 80-150%. In addition, LED lamps are sensitive to power system disturbances like a voltage sag. Even though a voltage sag lasts for few milliseconds, it may cause the lamp to flicker or even get damaged in some cases. Especially lighting networks which are located near large industrial facilities, such as for example an electric arc furnace, voltage flickers make light intensity changing accordingly. Several studies were conducted on improving the LED performance focusing on enhancing the design of the internal ballast circuit, however those techniques add more complexity and cost to the system, while focusing on power factor correction only. Another simple method is to connect capacitors in front of the ballast. The drawback of this method is, if the load impedance has changed, the degree of power factor correction cannot respond since the capacitors are passive components.

Accordingly, systems and methods that enable improved power quality provided to largescale LED lighting networks remains highly desirable.

BRIEF DESCRIPTION OF THE DRAWINGS

Further features and advantages of the present disclosure will become apparent from the following detailed description, taken in combination with the appended drawings, in which:

FIG. 3-3A shows a representation of LED lamp characteristics input supply voltage and current;

DETAILED DESCRIPTION

In accordance with an aspect of the present disclosure there is provided a transformerless unified power quality conditioner comprising: an active power filter (APF) coupled to an alternating current grid source, the APF injecting harmonic currents and reactive current to provide unity power factor of a received grid current provided to a light emitting diode (LED) load; and a dynamic voltage restorer (DVR) coupled to the APF, the DVR compensating for voltage flickering of the light emitting diode (LED) load from a grid voltage.

Embodiments are described below, by way of example only, with reference to FIGS. 1-14.

Figure 1A:
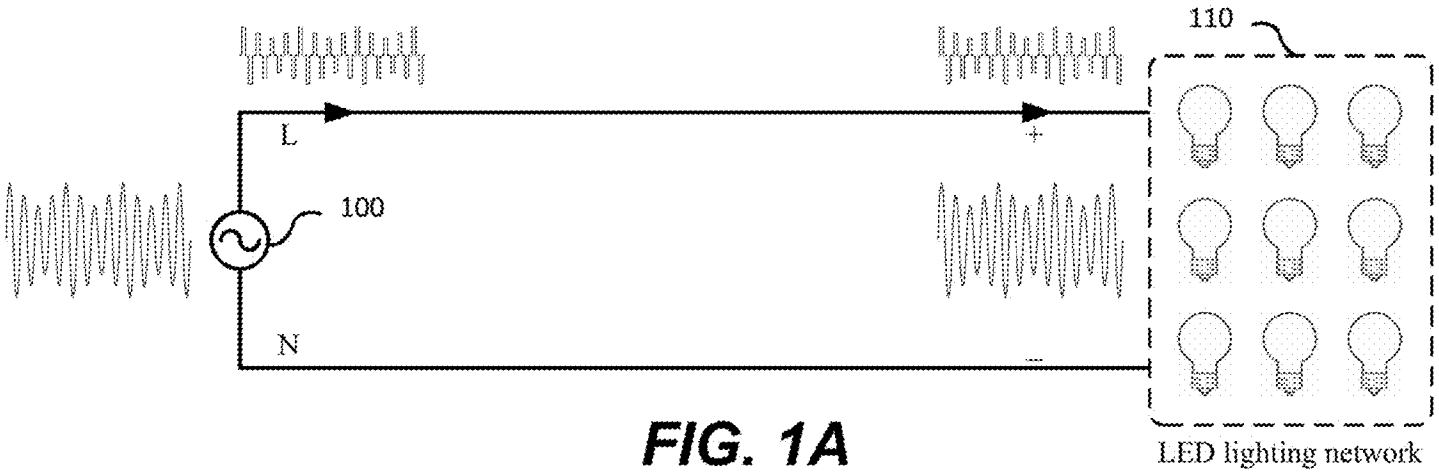
FIG. 1A shows a representation of a light emitting diode (LED) lighting network having voltage sag.

A comprehensive Power Quality (PQ) solution to improve grid current harmonics and light intensity flickers in large scale LED lighting networks is provided. Low cost and low power LED lamps exhibit current harmonic contents due to their nonlinear characteristics. A large scale lighting network requires tens to hundreds LED lamp installations, the resultant harmonic currents pollute the grid seriously. Furthermore, light intensity fluctuations are becoming a concern nowadays to many users, as a safety and a health problems. This phenomenon is mainly caused by heavy loads as they lead to voltage fluctuations and deteriorating in PQ and hence visual flickering in LED lamps. As shown in FIG. 1A, the power system 100 can experience disturbances caused by other devices on the network which can result in the light output causing flickering in the LED network 110.

Figure 1B:
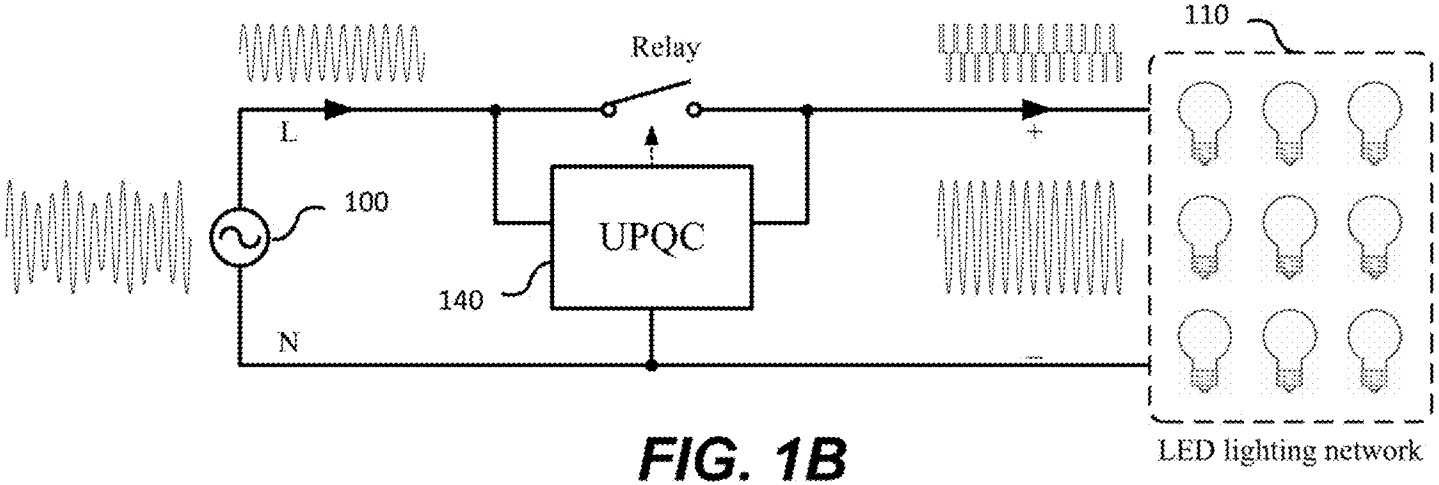
FIG. 1B shows a representation of a LED lighting network having a unified power quality conditioner (UPQC) to correct voltage sag.

As shown in FIG. 1B, the transformer-less unified power quality conditioner (UPQC) topology 140 mitigates all critical power quality issues with one system including voltage dips, swells, flickering, harmonics and power factor. A single phase transformer-less UPQC topology is provided with its controls to mitigate all PQ problems in a network. An active power filter injects harmonic currents and reactive current to provide unity power factor and a dynamic voltage restorer supports the load voltage for any voltage dip or flickering in the network.

Figure 2:
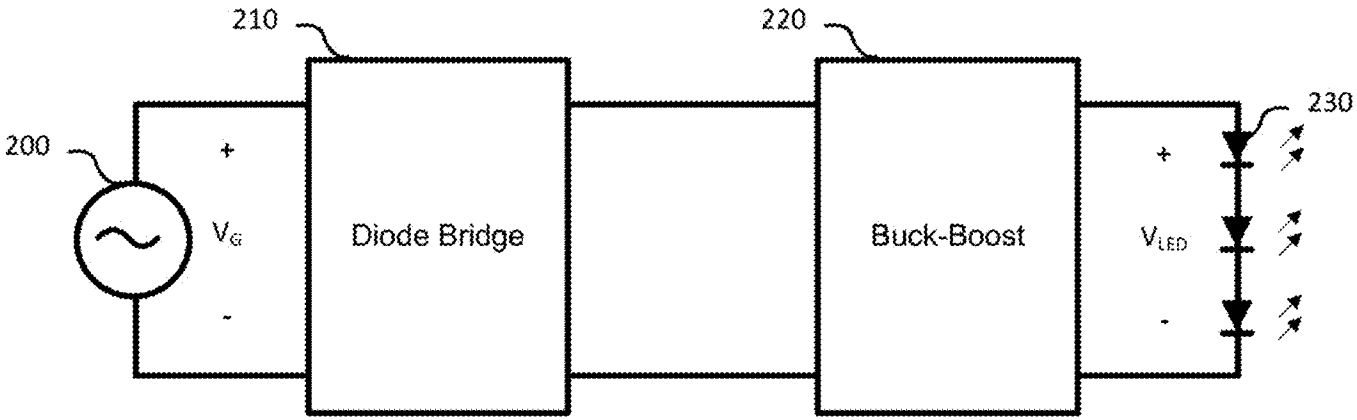
FIG. 2 shows a representation of a typical block diagram of LED driver.
Figure 3A:
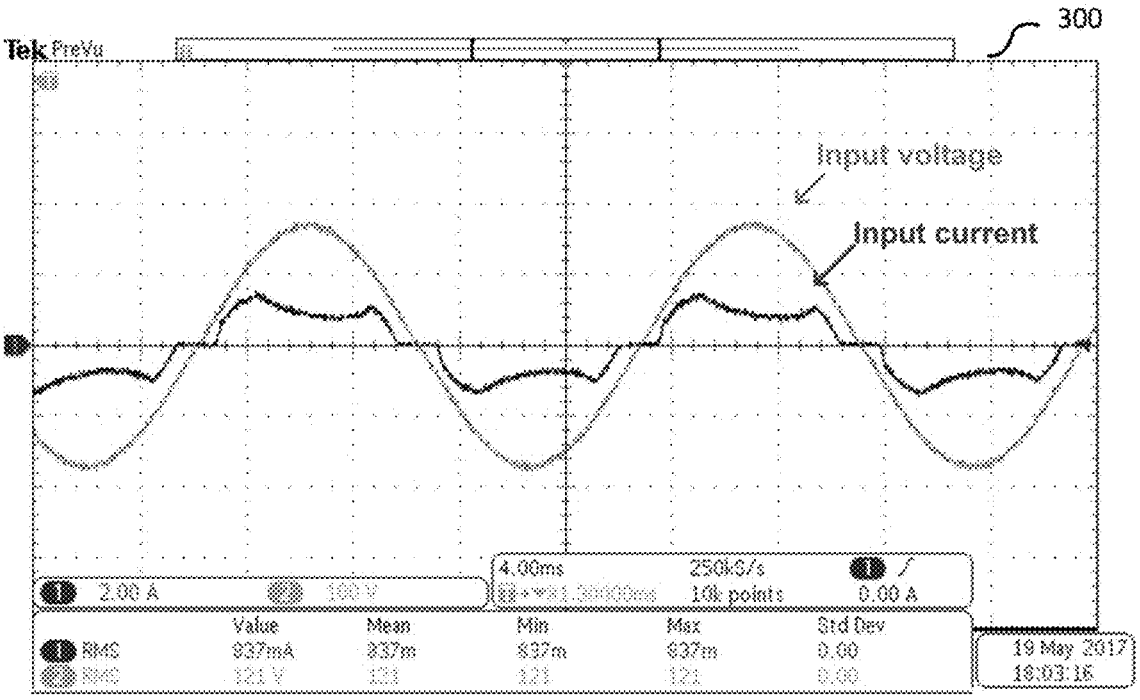
Figure 3B:
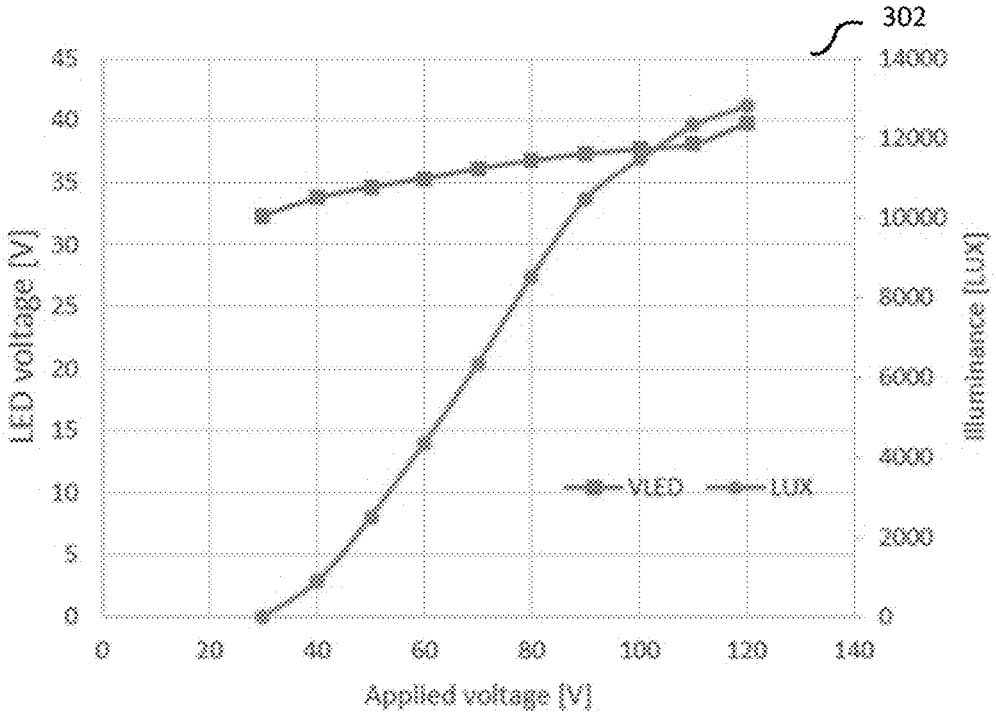
FIG. 3B shows a representation of LED lamp characteristics applied voltage vs. LED voltage and light intensity.

An LED is typically driven by a power electronic converter which includes a diode bridge and a buck-boost converter. A typical block diagram of LED is shown in FIG. 2. The diode bridge 210 is used to rectify AC grid voltage 200 and the buck-boost converter 220 maintains voltage and driving power of a LED string 230, furthermore, it provides dimming capability in addition. FIG. 3A in graph 300 demonstrates the nonlinear characteristics of an LED bulb as a load, it can be noted the distortion of the input current. The reason is a diode bridge is in the front of the driver but without a power factor correction in the circuit. Despite the fact that an individual LED bulb would have a very minor effect on a distribution feeder, a large number of LEDs connected to the same feeder i.e. street lighting, will introduce a high harmonic distortion level.

Flickering can be defined as a visual rapid change in the intensity of the lamp's light. This phenomenon has a negative impact on human health as it causes distraction, headaches or even epileptic seizures. Flickering is typically caused by voltage fluctuations in an electrical power network. Major disturbing load that cause voltage flickering at the point of common coupling, such as for example an electric arc furnace (EAF) used in steel manufacturing industry. EAF produces random voltage variations over a wide frequency range, where a human eye is sensitive to light variations in a low frequency range, of 5-10 Hz, this causes a visible and annoying flickering phenomenon. As shown in graph 302 of FIG. 3B the direct relation between the luminous intensity of the LED and the applied voltage. It can be noted that luminous flux per unit area is varying with the variation of the ripple voltage across the LED.

Figure 4:
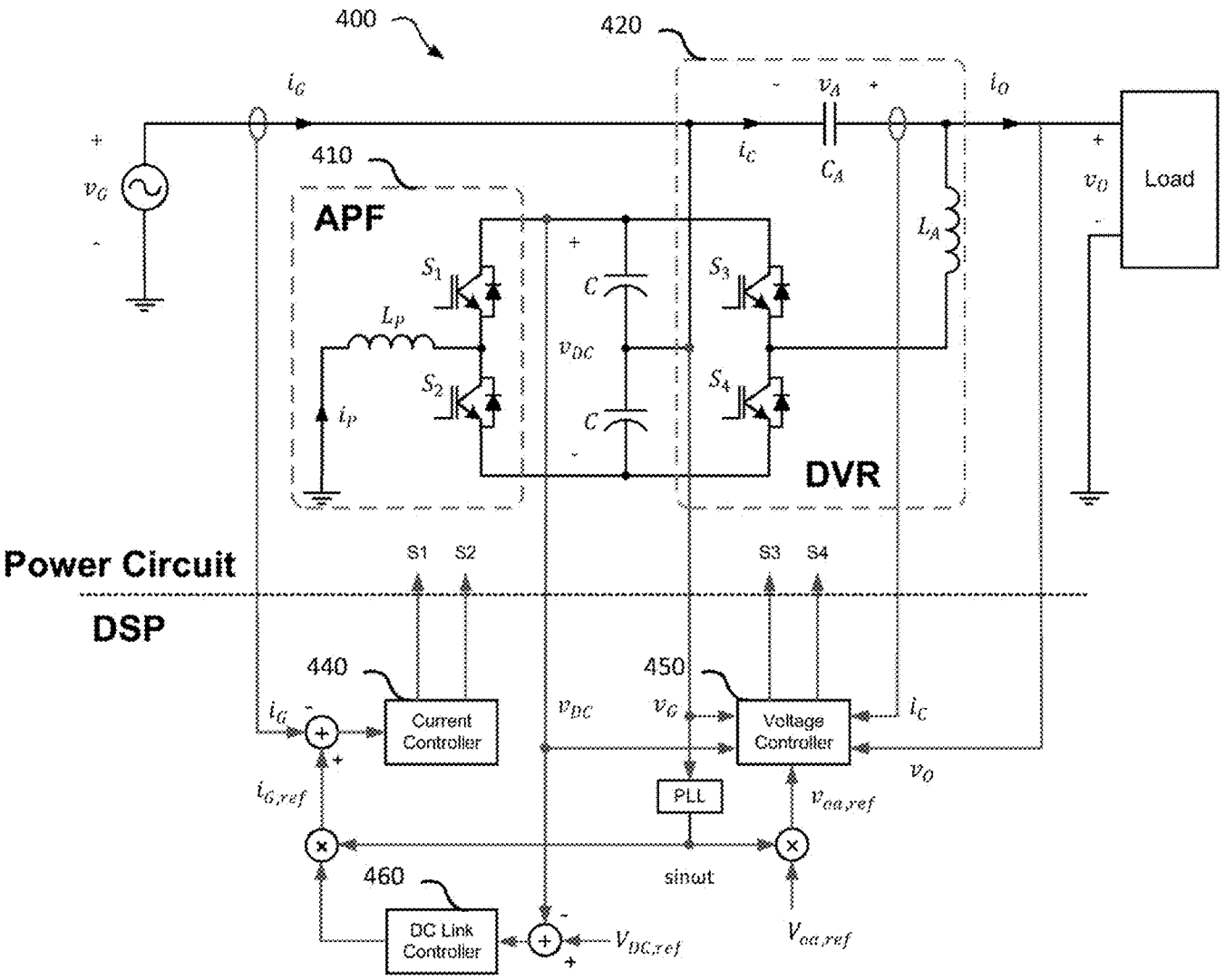
FIG. 4 shows a transformer-less single-phase UPQC.

FIG. 4 shows a novel transformer-less single-phase Unified Power Quality Conditioner (UPQC) topology 400. The topology consists of a full bridge inverter which can be divided into two half bridge bi-directional voltage source inverters (VSI), i) Active Power Filter (APF) 410 to inject compensating harmonic currents, and ii) Dynamic Voltage Restorer (DVR) 420 to compensate voltage flickering. The topology and the configuration gives the following advantages:

1) Transformerless—no transformer in between the inverter and the grid. It leads high efficiency and power density, and cost effective.
2) Low common-mode (CM) voltage—since transformer is absent, CM voltage and leakage current become significant. The topology can guarantee low CM voltage due to the Line connecting to the mid-point of the capacitor bank. The potential difference between the grid and the converter is clamped.
3) Simple topology—the topology only has two active devices for each power stage, it is cost effective and reduce the complexity of controller design.

The shunt APF injects current harmonics and reactive power to compensate the distorted current of the load. Thus, there are two control objectives, 1) the input current and 2) the DC (direct current) link voltage, in the control system. And it requires two control loops to perform the functions. The DC link voltage controller 460 is to determine the fundamental component of the load current, and the input current controller is to force the actual input current to be the same as the determined fundamental current. If there is a voltage dip or variation, the series DVR 420 is responsible to inject a voltage in series with the supply voltage to compensate the difference between the nominal voltage and the required voltage to be applied. The DVR 420 can be seen as a controllable voltage source that is placed between the input supply voltage and the load. To control the DVR 420 behavior a reference voltage is given to it. This reference signal can take any value to control the voltage applied to the load therefore this topology can also be used to perform as a dimmer for the LED lamp lighting network.

Figure 5:
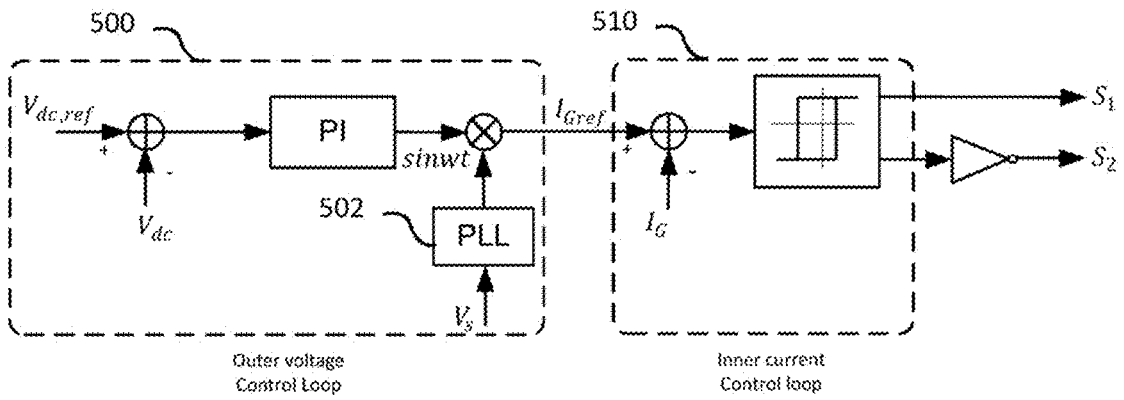
FIG. 5 shows a control block diagram of an active power filter (APF)
Figure 6:
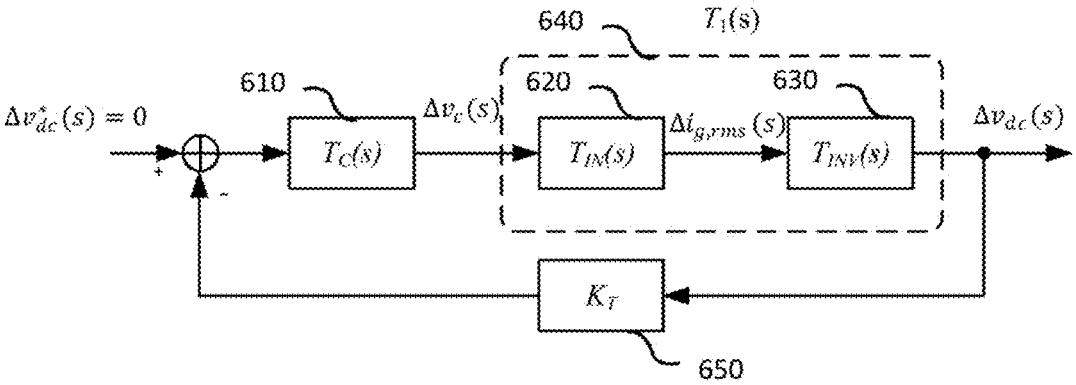
FIG. 6 shows a small-signal control loop block diagram of an APF.

As mentioned in the previous section, there are two controllers in the shunt APF 410, which is shown in FIG. 5 they are voltage controller 440 and current controller 450. Both controllers can be implemented by either Digital Signal Processing (DSP) or Analog circuits. The outer voltage control loop 500 is used to fix the DC link voltage while the inner current control loop 510 shapes the input current by comparing it to a reference signal that is generated by the phase locked loop (PLL) 502.

In small signal model, harmonic components in the load current are neglected as the dynamic of the system is slower than that of harmonics. The fundamental components are considered in the analysis. In order to analyze the dynamic behaviors of the system, small signal models are determined. The control block diagram is given in FIG. 6. The output of the control loop is the DC link voltage. The controller $T_c$ 610 generates a control signal. The power plant $T_1$ includes inner control loop and inverter transfer functions.

The transfer function of the inverter $T_{INV}(S)$ 630, the inner loop $T_{IN}(S)$ 620, and the overall power stage $T_1(s)$ 640 are given in equations (1), (2) and (3) respectively:

$$T_{INV}(s) = \frac{\Delta v_{dc}(s)}{\Delta i_{g,rms}(s)} = \frac{2V_{G,rms}}{C \cdot V_{DC}} \cdot \frac{1}{s} \tag{1}$$

$$T_{IN}(s) = \frac{\Delta i_{g,rms}(s)}{\Delta v_c(s)} = \frac{1}{\sqrt{2}\,K_{Ti}} \tag{2}$$

$$T_1(s) = T_{IN}(s) \cdot T_{INV}(s) = \frac{1}{\sqrt{2}\,K_{Ti}} \frac{2V_{G,rms}}{C \cdot V_{DC}} \cdot \frac{1}{s} \tag{3}$$

where $K_{Ti}$: is the sensor gain of the grid current.

A PI control is used to control the power stage, which has the following transfer function, $$T_c(s) = \frac{\Delta v_c(s)}{\Delta v_{dc}(s)} = K_T\left(K_p + \frac{K_i}{S}\right) \tag{4}$$

where $K_T$: 650 is the sensor gain of the load voltage.

For the series DVR the controller methodology is based on boundary control with second order switching surface in which the switching trajectory is used to predict the moves of voltages and currents of passive components, and then gives switching decisions (gate signals) to the inverter at the right moment. This prediction ensures a very fast dynamic response to any external disturbance. The load reference voltage $v_o^*$ is generated by the phase locked loop (PLL) from which the DVR reference voltage $v_A^*$ can be generated as follows:

$$v_A^*(t) = v_o^*(t) - v_G(t) \tag{5}$$

where $v_G(t)$ is the grid voltage.

The amplitude of $v_o^*(t)$ is regulated at a desired RMS (root mean square) value with the same frequency of the grid voltage. The gate signals to the switches are determined by the following criteria:

Criteria of Switching $S_3$ Off and $S_4$ on

Figure 7:
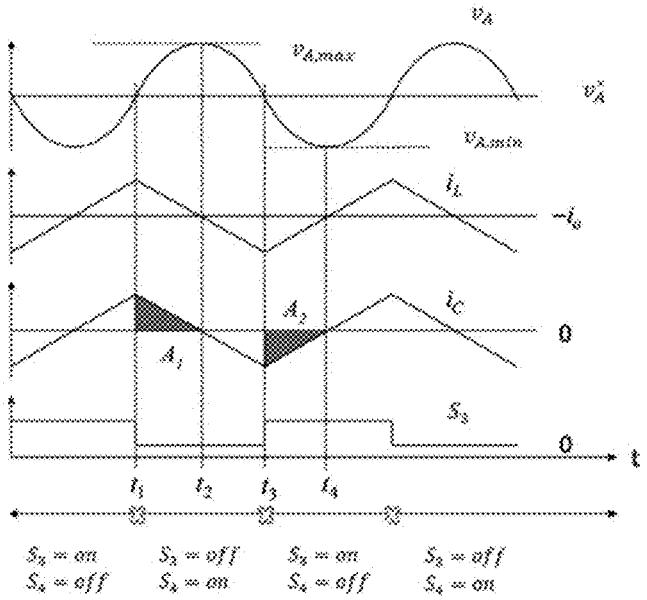
FIG. 7 shows a typical waveforms of the capacitor voltage and current of the DVR.

As illustrated in FIG. 7, $S_3$ and $S_4$ will turn off and on at hypothesized time instant $t_1$, so that when $i_C=0$, $v_A$ will be equal to $v_{A,max}$ at $t_2$, thus $$-\frac{v_{dc}}{2} - v_A(t) = L\frac{di_L}{dt} \tag{6}$$

As $i_C = i_L + i_o$ $$\frac{di_C}{dt} = \frac{di_L}{dt} = -\frac{\left(\frac{v_{dc}}{2} + v_A(t)\right)}{L} \tag{7}$$

The series capacitor voltage is given by $$v_A = \frac{1}{C}\int i_C(t)dt + v_A(0) \tag{8}$$

Where $\sigma_A(0)$ is the initial capacitor voltage, the integration of capacitor current from $t_1$ to $t_2$ is given by the triangular area surrounding by capacitor current waveform and $t_1$ and $t_2$ time axis and can be written as follows $$\int_{t_1}^{t_2} i_C(t)dt = \frac{1}{2}i_C(t_1)\Delta t \tag{9}$$

At time instant $t_2$ and by combining the above equations, the peak capacitor voltage can be obtained as such $$v_{A,max} = v_A(t_2) = \left[\frac{L}{2C}\frac{1}{\frac{v_{dc}}{2} + v_A(t)}\right]i_C^2(t_1) + v_A(0) \tag{10}$$

In order to ensure that $v_A$ will not go beyond $v_{A,max}$, the following two conditions must be fulfilled $$v_A(t) - v_{A,max} + \left[\frac{L}{2C}\frac{1}{\frac{v_{dc}}{2} + v_o(t)}\right]i_C^2(t) \geq 0 \text{ and} \tag{11}$$

$$i_c(t) \geq 0 \tag{12}$$

Criteria of Switching $S_3$ on and $S_4$ Off

Similarly, by observing the time integral from $t_3$ to $t_4$, the capacitor voltage will reach the minimum value at $t_4$, while the voltage across the inductor is given by $$\frac{v_{dc}}{2} - v_A(t) = L\frac{di_L}{dt} \tag{13}$$

In order to ensure that $v_A$ will not go beyond $v_{o,min}$, the following two conditions can be derived as following the group of equations (6) to (12).

$$v_A(t) - v_{o,min} - \left[\frac{L}{2C}\frac{1}{\frac{v_{dc}}{2} - v_o(t)}\right]i_C^2(t) \leq 0 \text{ and} \tag{14}$$

$$i_c(t) \leq 0 \tag{15}$$

Figure 8:
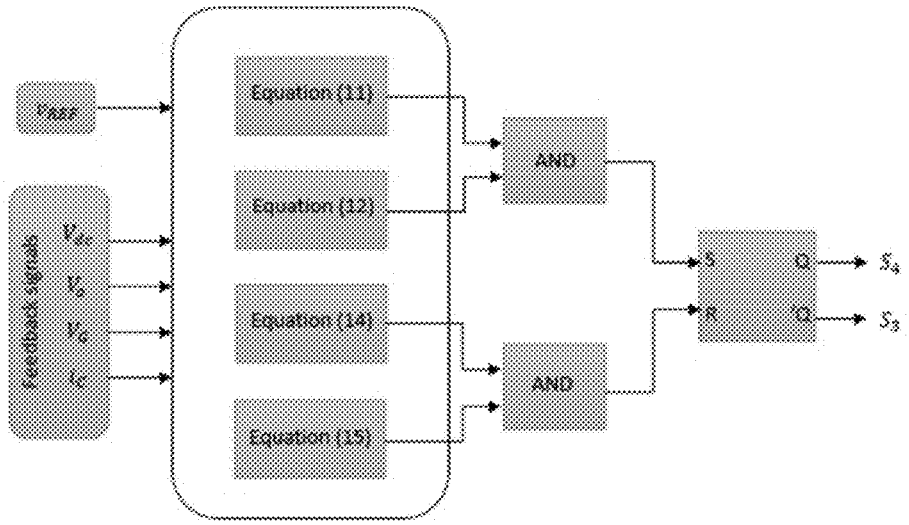
FIG. 8 shows a control law of the boundary controller.
Figure 9:
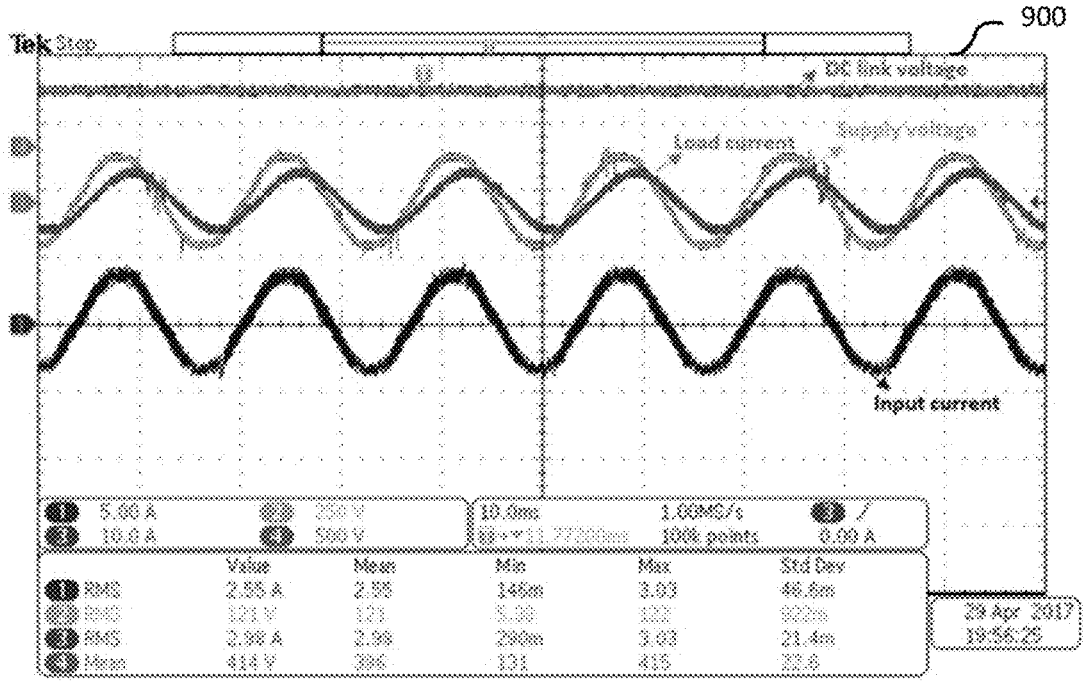
FIG. 9 shows APF experimental results with reactive power compensation.
Figure 10:
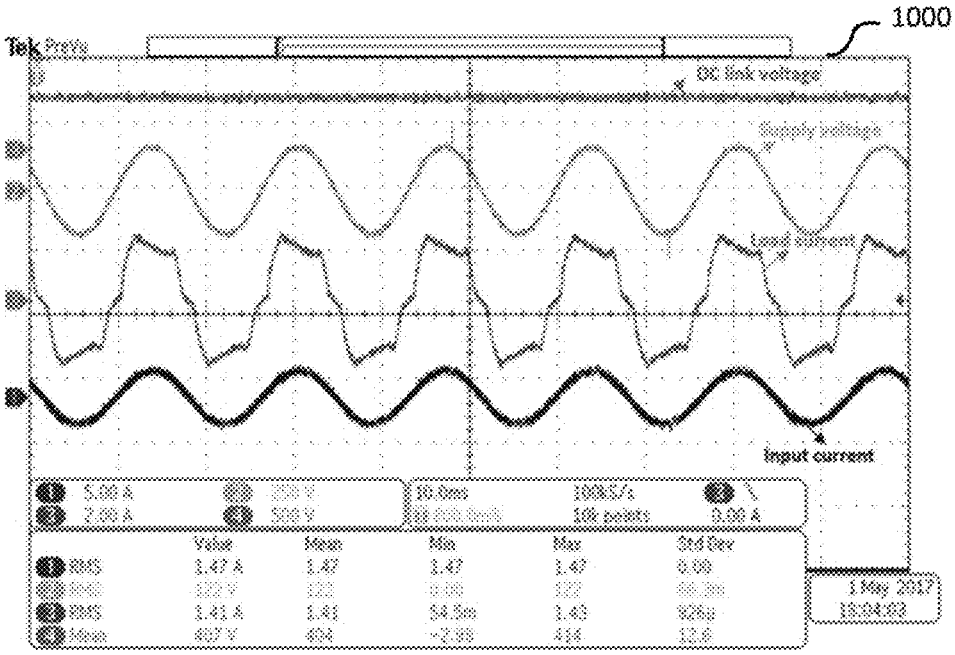
FIG. 10 shows APF experimental results with nonlinear load.
Figure 11:
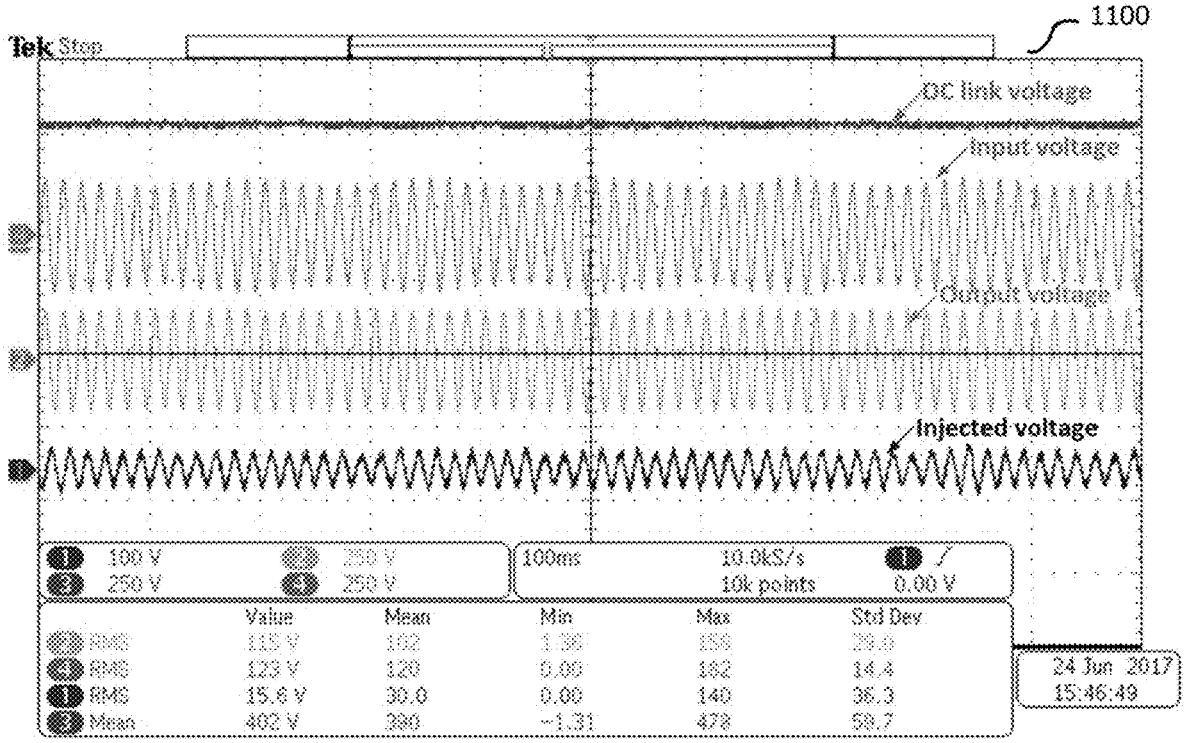
FIG. 11 shows a dynamic voltage restorer (DVR) experimental results for 6 Hz input voltage flickering.

FIG. 8 shows the implementation of the boundary control conditions by following the two switching criteria that have been developed from the steady state characteristics with reference to the equations described.

Figure 12A:
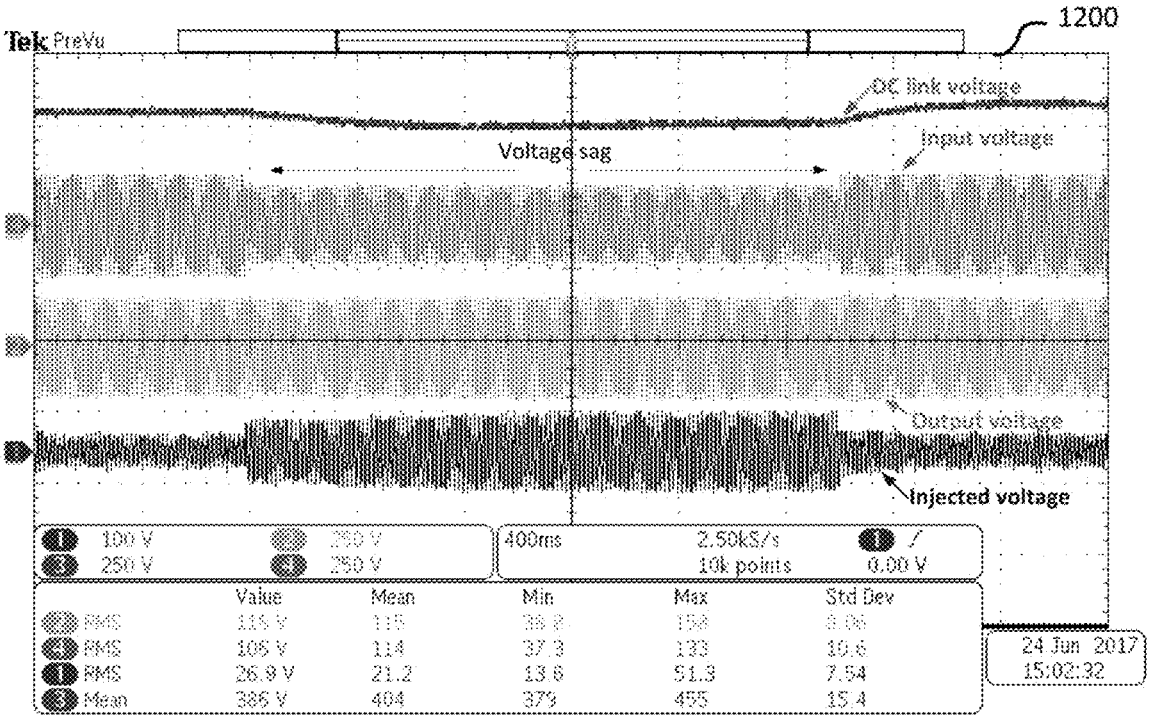
FIG. 12A shows DVR experimental results for voltage sag.
Figure 12B:
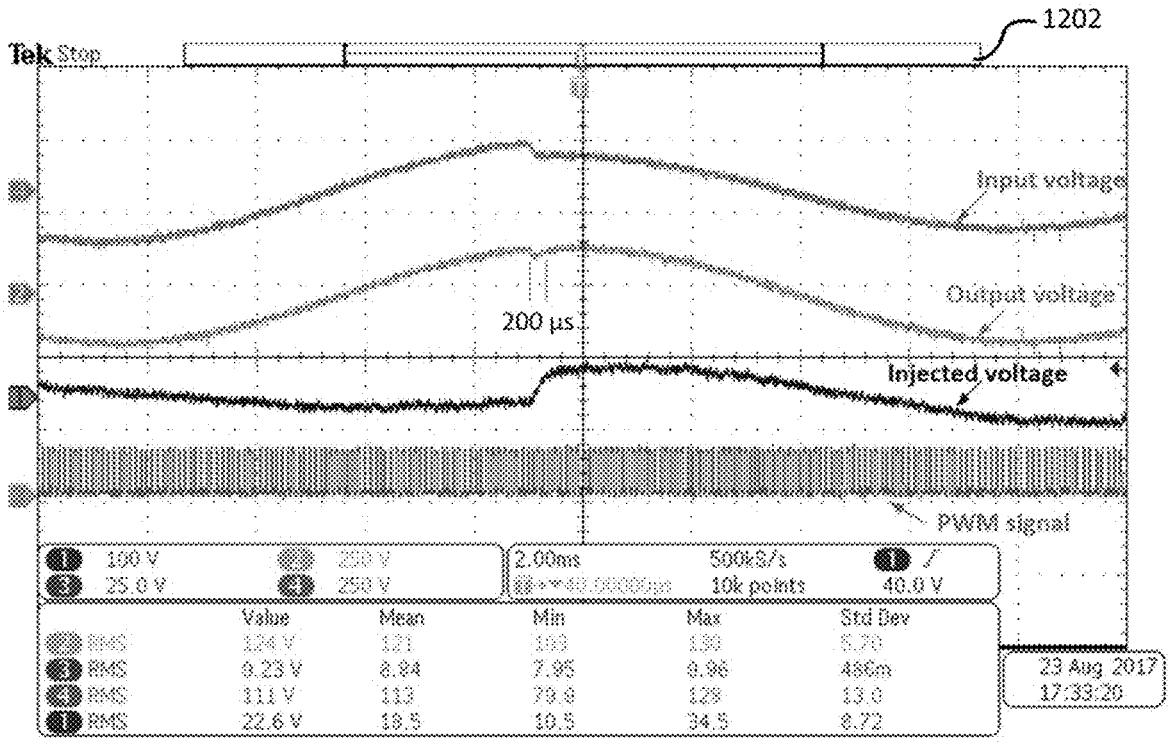
FIG. 12B shows DVR experimental results for enlarged waveforms of voltage sag.
Figure 13A:
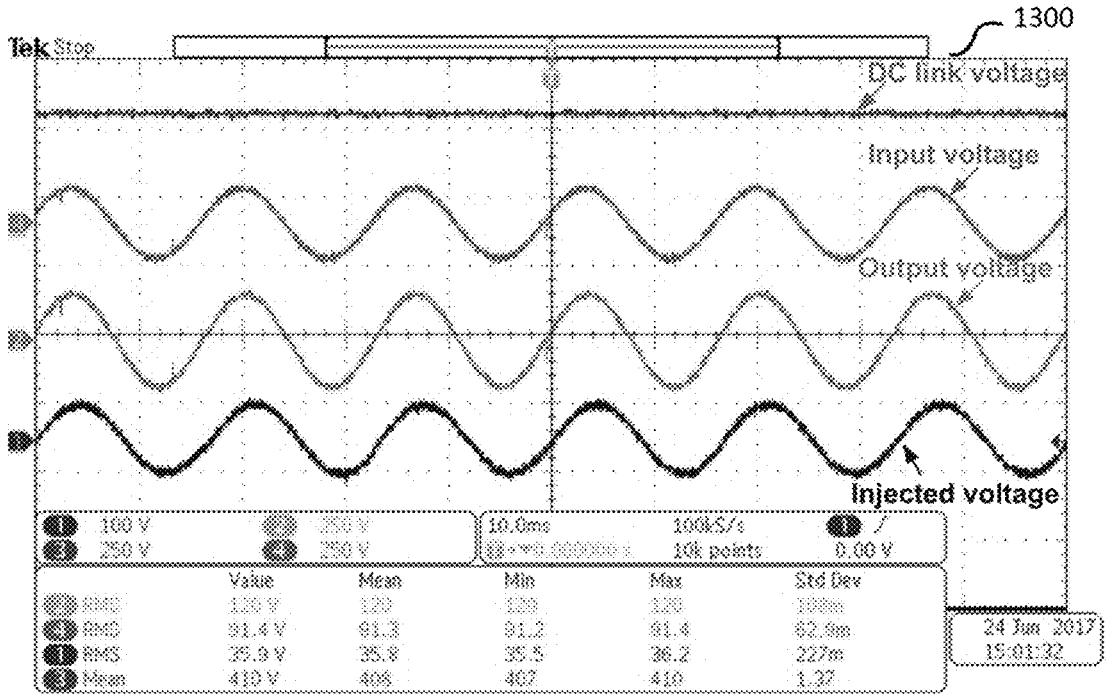
FIG. 13A shows DVR experimental results for under voltage 90V.
Figure 13B:
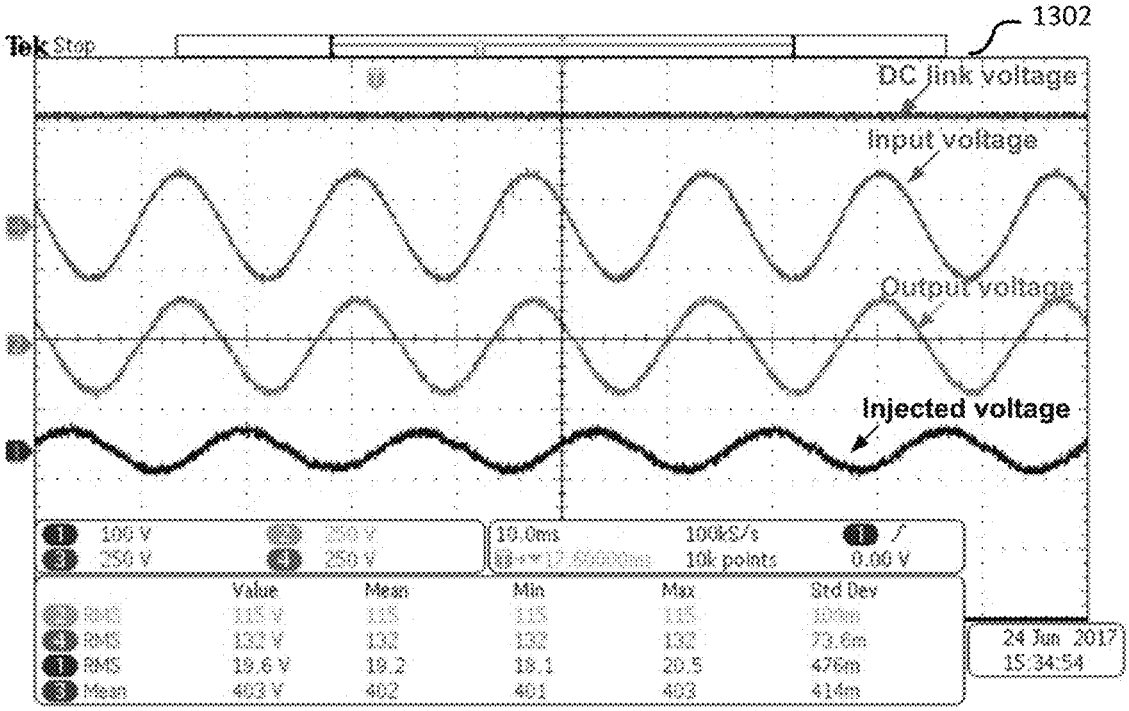
FIG. 13B shows DVR experimental results for over voltage, 130V.
Figure 14A:
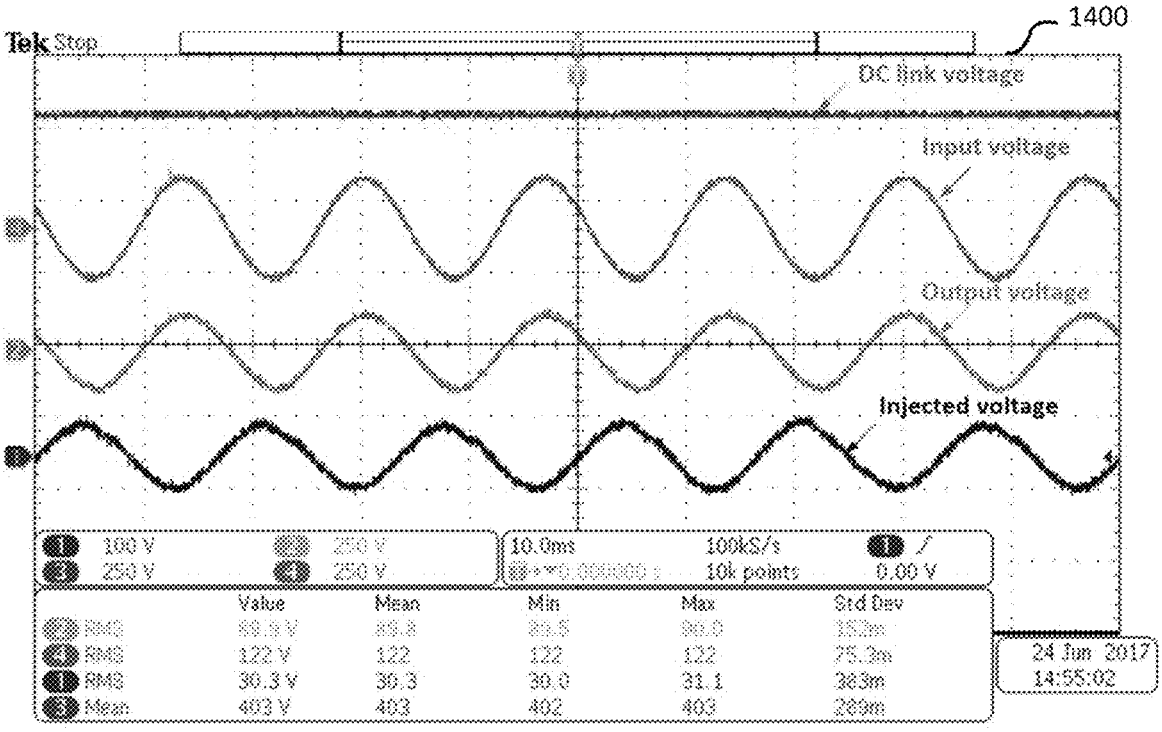
FIG. 14A shows DVR experimental results for regulated output voltage at 90V RMS.
Figure 14B:
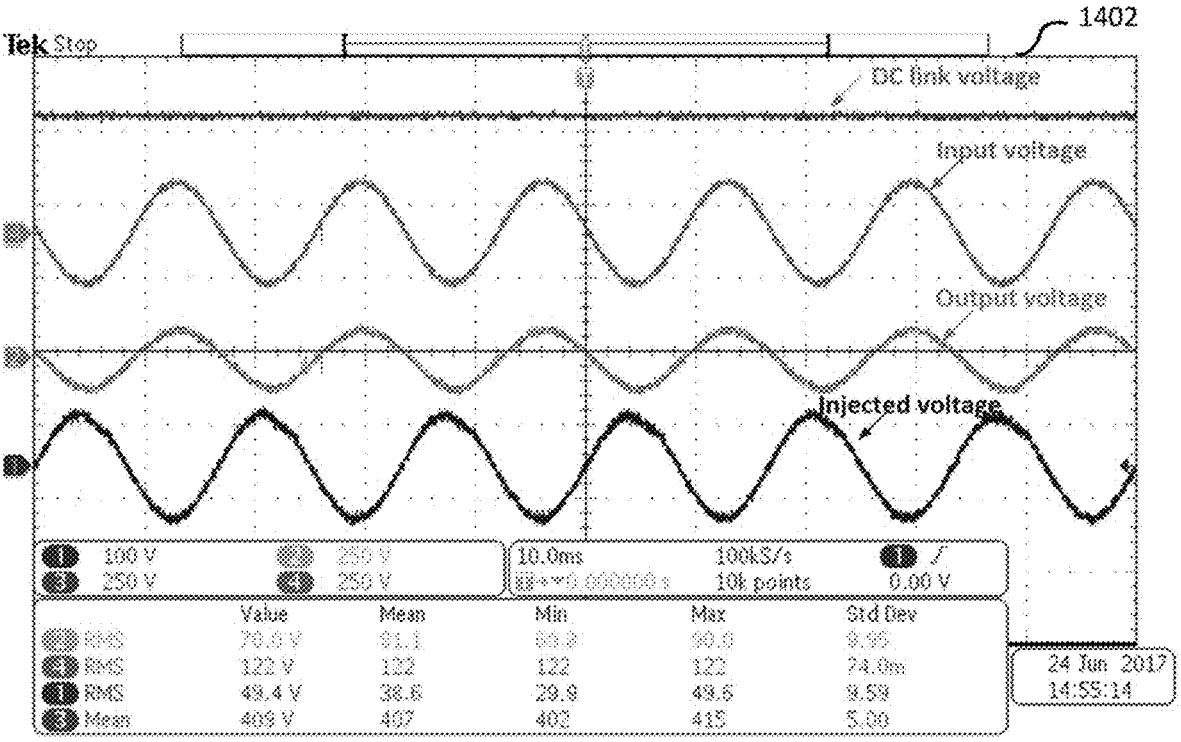
FIG. 14B shows DVR experimental results for regulated output voltage at 70V RMS It will be noted that throughout the appended drawings, like features are identified by like reference numerals.

A 500 VA/120 V UPQC converter prototype with DSP controller was implemented to experimentally verify the proposed converter. Two types of loads were used. A linear load which consists of a resistor and an inductor to represent reactive power delivery of the APF in graph 900 of FIG. 9, and a nonlinear load that consists of 9 LED lamps in parallel with a resistor in graph 1000 of FIG. 10. The DC link was maintained at a constant value of 400 V. It can be seen that in regard to a linear load and a nonlinear load, the input current can be controlled as a sinusoidal waveform with the same phase as the input voltage, i.e. power factor equals to 1, where the APF has compensated reactive power and all harmonics contents. In order to simulate the visual flickering phenomena in LED lamps, a modulated waveform signal of 6 Hz in the input voltage was generated in graph 1100 of FIG. 11. The results show that the output voltage is maintained as a sinusoidal waveform with a constant peak value. The DVR sources the power from the dc link capacitor and injects voltage to support the load voltage. A voltage sag of 25% in RMS input voltage for 2 seconds is shown in graph 1200 of FIG. 12A, while the output voltage is restored to 120V RMS and the DC link was able to restore the injected power through the parallel converter. The enlarged waveforms in graph 1202 of FIG. 12B show the fast dynamic response of the controller to support the network in 200 μs. Moreover the DVR supports the network under different circumstances. A constant output voltage of 120V rms is delivered for an under input voltage of 90V in graph 1300 in FIG. 13A, and for an over input voltage of 130V in graph 1302 of FIG. 13B. FIG. 14A & FIG. 14B show a steady state regulated output voltage at 90 V in graph 1400 and 70V in graph 1402 which corresponds to 80% and 50% of light intensity at rated voltage respectively. It indicates the capability of the proposed technique to operate at any desired value. This shows the advantage of the disclosed control scheme to add a dimming function to the LED lamps in addition to regulate the input current and the output voltage.

The APF turns unity power factor and filters out the harmonics generated by loads as well as compensates all voltage fluctuations in the supply voltage to prevent LED flickering. Reactive power control has been used to balance the input and output powers of the APF with using capacitor bank voltage.

Each element in the embodiments of the present disclosure may be implemented as hardware, software/program, or any combination thereof. Software codes, either in its entirety or a part thereof, may be stored in a computer readable medium or memory (e.g., as a ROM, for example a non-volatile memory such as flash memory, CD ROM, DVD ROM, Blu-Ray™, a semiconductor ROM, USB, or a magnetic recording medium, for example a hard disk). The program may be in the form of source code, object code, a code intermediate source and object code such as partially compiled form, or in any other form.

It would be appreciated by one of ordinary skill in the art that the system and components shown in FIGS. 1-14 may include components not shown in the drawings. For simplicity and clarity of the illustration, elements in the figures are not necessarily to scale, are only schematic and are non-limiting of the elements structures. It will be apparent to persons skilled in the art that a number of variations and modifications can be made without departing from the scope of the invention as defined in the claims.

The invention claimed is:

1. A transformerless single phase unified power quality conditioner comprising:

a dynamic voltage restorer (DVR) coupled serially and directly in between an alternating grid source and load, the DVR compensating for voltage flickering of the light emitting diode (LED) load from a grid voltage; and an active power filter (APF) coupled to an alternating current grid source, the APF injecting harmonic currents and reactive current to provide unity power factor of a received grid current provided to a light emitting diode (LED) load and provide energy to DVR to support the load voltage;

wherein the APF and DVR are voltage source converters or inverters with at least two power semiconductor switches in each converter, and the converters are interconnected with at least two capacitors.

2. The power conditioner of claim 1 further comprising an outer voltage control loop to fix a DC link voltage.

3. The power conditioner of claim 2 further comprising an inner current control loop to shape an input current by comparing it a reference signal that is generated by a phase locked loop (PLL).

4. The power conditioner of claim 3 wherein a load reference voltage is generated by a phase locked loop (PLL) from a DVR reference voltage.

5. The power conditioner of claim 3 wherein the outer voltage control loop is implemented by a voltage controller coupled to the PLL.

6. The power conditioner of claim 5 wherein the voltage controller is implemented in a digital signal processor (DSP) or an analog circuit.

7. The power conditioner of claim 5 wherein the inner current control loop is implemented by a current controller.

8. The power conditioner of claim 7 wherein the current controller is implemented in a digital signal processor (DSP) or an analog circuit.

9. The power conditioner of claim 7 further comprising a DC link controller.

10. The power conditioner of claim 9 wherein the DC link controller determines the fundamental component of a load current, and the input current controller is to force an actual input current to be the same as a determined fundamental current.

11. The power conditioner of claim 10 wherein if there is a voltage dip or variation, the DVR injects a voltage in series with the supply voltage to compensate the difference between a nominal voltage and a required voltage to be applied to the load.

12. The power conditioner of claim 11 wherein a reference voltage is provided to the DVR, the reference voltage can take any value to control the voltage applied to the load.

13. The power conditioner of claim 1 wherein an APF first switch and a second switch S2 are in series, where S1 and S2 are connected in parallel with a pair of series capacitors.

14. The power conditioner of claim 13 wherein S1 and S2 are coupled at a mid-point to ground by an inductor.

15. The power conditioner of claim 14 wherein the DVR comprises a third switch S3 and a fourth switch S4 in series, where S3 and S4 are connected in parallel with the pair of series capacitors opposite of S1 and S2.

16. The power conditioner of claim 15 wherein S3 and S4 are coupled at a mid-point to an AC voltage source by an inductor connected to the load.

17. The power conditioner of claim 1 wherein comprising at least one LED light with a driver circuit to provide dimming function by controlling an LED light supply voltage.

* * * * *